US006009823A

United States Patent [19]

Gross

[11] Patent Number: 6,009,823

[45] Date of Patent: Jan. 4, 2000

[54] MARINE SCOOP STRAINER WITH CLEANING ACCESS

[76] Inventor: Donald Gross, 7240 Standard Dr., Hanover, Md. 21076

[21] Appl. No.: 09/179,585

[22] Filed: Oct. 27, 1998

Related U.S. Application Data

[60] Provisional application No. 60/076,921, Mar. 5, 1998.

[51] Int. Cl.[7] ..... B63B 13/00

[52] U.S. Cl. ..... 114/198; 440/88

[58] Field of Search ..... 210/163; 114/197, 114/198; 440/46, 88

[56] References Cited

U.S. PATENT DOCUMENTS 3,878,807 4/1975 Reskusic et al. ..... 114/198

4,809,632 3/1989 Hamel ..... 114/198

5,224,887 7/1993 Futaki ..... 440/46

*Primary Examiner*—E. Swinehart

*Attorney, Agent, or Firm*—Walter C. Farley

[57] ABSTRACT

A scoop strainer has a rim to attach the strainer to an outer surface of a hull of a marine vessel over a through-hull fitting intended to admit water to the interior of the hull. The strainer has small openings therethrough to pass water but not large undesired objects or marine life, and a larger opening to permit access to the interior of the strainer and to the through-hull fitting to clean out marine growth and the like. A cover is hinged to the strainer and is movable between an open, access position and a closed position. A threaded fastener passing through the cover threads into the rim to selectively hold the access cover closed.

4 Claims, 2 Drawing Sheets

MARINE SCOOP STRAINER WITH CLEANING ACCESS

This application claims benefit of providsional application 60/076, 921 filed Mar. 5, 1998.

FIELD OF THE INVENTION

This invention relates to a scoop strainer for admitting water to a through-hull conduit into a cooling system or the like within a marine vessel, and particularly to an improved access for cleaning the strainer and conduit.

BACKGROUND OF THE INVENTION

It is common practice to provide a water opening outside the hull of a marine vessel with a conduit passing through the hull so that cooling water and the like can enter. It is also common practice to provide a scoop to use forward motion of the vessel to facilitate entry of the water and to provide a strainer as part of the scoop. The purpose of the strainer is to keep objects and marine life from entering the cooling system. Generally speaking, while the strainer and through-hull fitting can take various forms, the strainer is likely to be dimensioned so that objects larger than about ⅛ inch across will be excluded. An example of an intake strainer of this general type is shown in U.S. Pat No. 3,878,807, Reskusic et al.

However, very small forms of marine life can still enter and, while they do not present a serious problem for the cooling systems, it is common for them to congregate near the entry of the through-hull fitting. In particular, barnacles, mussels and the like tend to attach themselves to the strainer as well as the entry area of the pipe and then grow, ultimately reducing the flow to unacceptable levels.

When this happens, it is necessary to remove the strainer and scoop and to dean the pipe leading through the hull. Such strainers are normally attached to a wood or fiberglass hull using threaded fasteners which thread directly into the hull, as shown in Reskusic et al. Unfortunately, after several times of removing the strainer, cleaning it and then replacing the strainer, the internal threads in the hull have deteriorated so much that the fasteners no longer hold. It is then necessary to take more drastic steps to replace the fasteners with larger ones or change to a different type of fastener system, neither of these solutions being very good ones.

The basic strainer-cleaning problem has been recognized for some time and efforts have been made to arrive at solutions which obviate the need to remove and replace fasteners in the hull material. An example of this is shown by U.S. Pat. No. 4,809,632, Hamel in which a drawer is built into the strainer. When the strainer becomes dogged with marine life, the objective of Hamel is to allow removal of the strainer which can then be cleaned and replaced. However, Hamel does not provide a complete solution because the shell of the scoop strainer blocks direct access to the through-hull tube. Since it is essential to be able to dean the interior of that tube as well as the strainer itself, the structure of Hamel is insufficient. In addition, it does not appear that the drawer system of Hamel would be very practical in a real marine environment because the sliding components thereof and the small components would not appear to stay in working order very long. A more practical system is therefore still needed.

SUMMARY OF THE INVENTION

Briefly described, the present invention comprises a scoop strainer for admitting water to and through a through-hull fitting in a marine vessel, the strainer comprising a shell having an open side and means for attaching the shell substantially permanently to the hull with the open side of the shell toward the hull and with the shell overlying the through-hull fitting. A plurality of water passage openings are provided through the shell along with an access opening through the shell. A cover is mounted in the access opening to be movable between a closed position in which the cover substantially closes the access opening and an open position in which the cover permits unobstructed access to the interior of the shell and to the through-hull fitting. The strainer further includes means for supporting the cover for pivotal motion between the closed and open positions, and means for selectively holding the cover in the closed position

BRIEF DESCRIPTION OF THE DRAWINGS

In order to elucidate the salient features of the invention by way of example, a preferred embodiment thereof will be described with reference to the following drawings wherein.

DESCRIPTION OF THE PREFERRED EMBODIMENT

Figure 1:
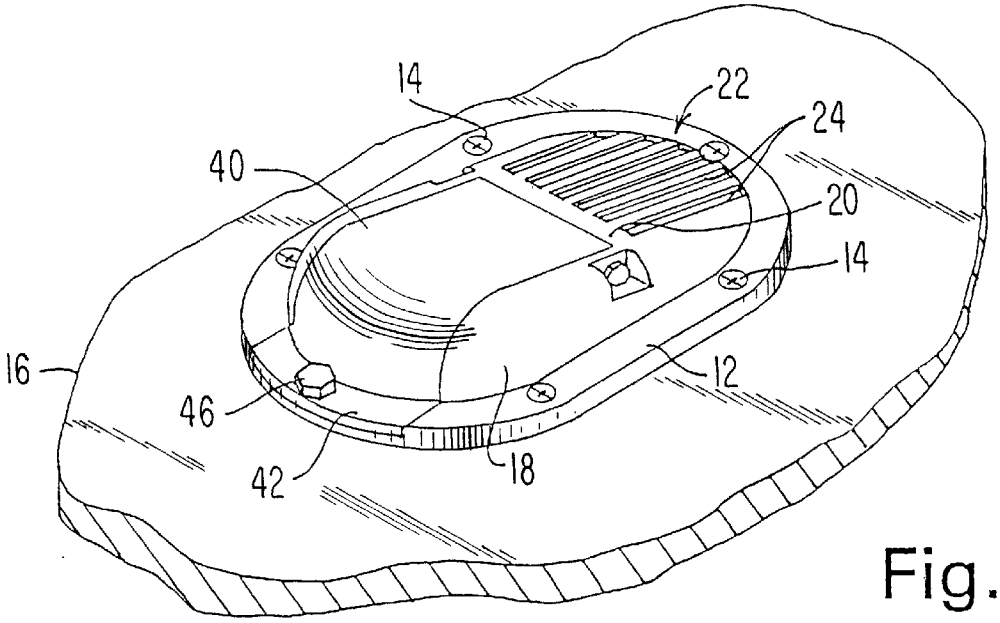
FIG. 1 is a perspective view of a scoop strainer in accordance with the invention with the access door thereof closed.
Figure 2:
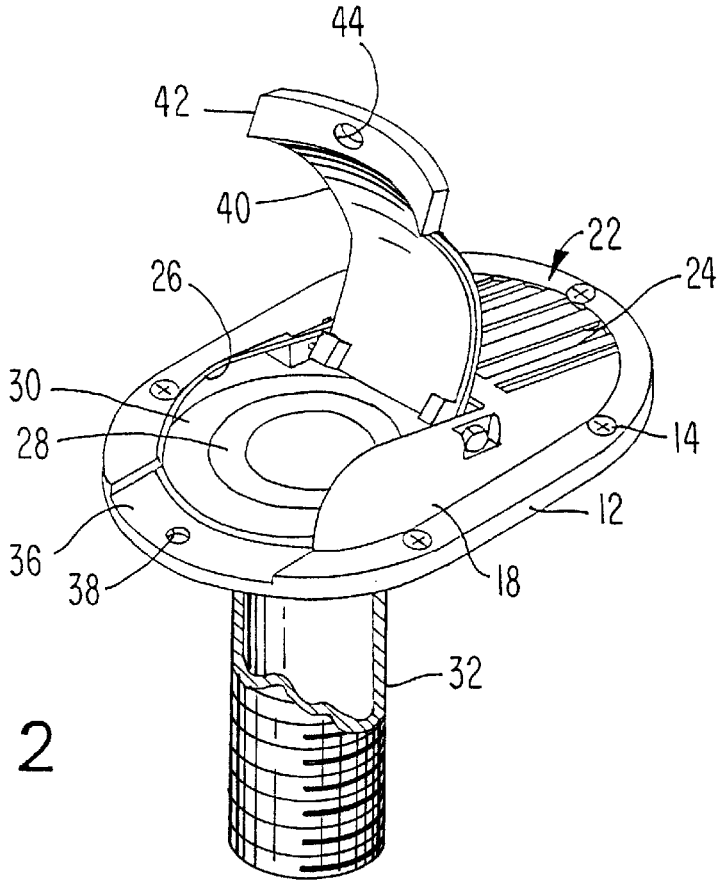
FIG. 2 is a perspective view of the scoop strainer of FIG. 1 with the access door open and showing a through-hull fitting which the scoop strainer covers.
Figure 3:
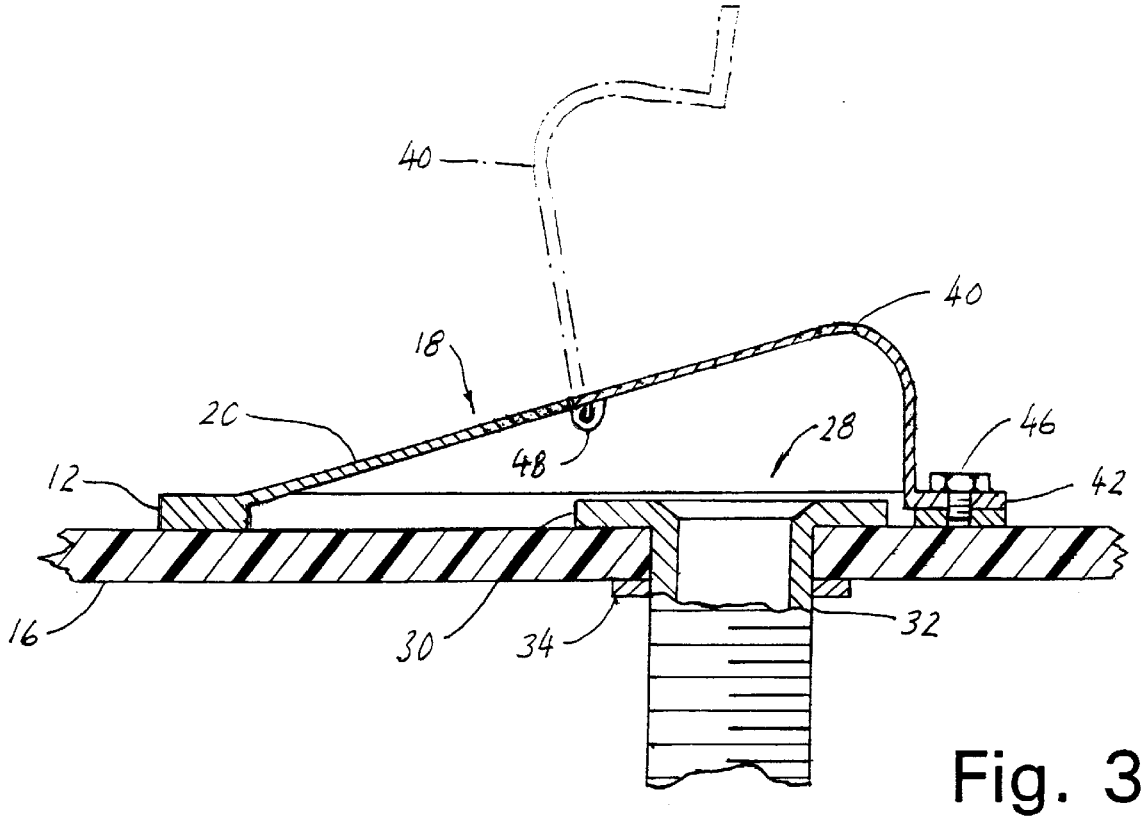
FIG. 3 is a sectional side elevation of the scoop strainer of FIGS. 1 and 2 mounted on a section of boat hull.

As shown in FIGS. 1–3, the scoop strainer of the present invention comprises a rim plate 12 which is elongated and, in the embodiment shown, has curved ends with openings therethrough to receive threaded fasteners, such as brass screws 14, to enter and engage the hull 16 of a marine vessel. The rim plate can also be made with straight ends, depending on the application. Within rim plate 12 is a scoop strainer which comprises a half-shell 18 having a sloping surface 20 making about a 15° angle with the plane containing the rim plate so that the strainer creates minimum resistance to water flow as the vessel passes through the water. For this purpose, end 22 of the strainer is used as the forward end. The side of shell 18 facing vessel hull 16 is open and unobstructed. Rim plate 12 and shell 18 are integrally formed or fixedly attached to each other so that the rim plate forms an outwardly extending flange around the periphery of the open side of the shell.

Surface 20 is penetrated by a plurality of openings 24 which can be in the shape of slots, as shown in FIG. 1, or which can be perforations, not illustrated. While the shape of these openings is not important, it is desirable to dimension the openings to exclude undesired abject to the extent possible and it is important to make sure that the total area of the openings is large enough to permit adequate water flow through the strainer for the cooling or other purpose for which it is being admitted.

At the rear end of scoop strainer 18 is an access opening 26 which, as viewed in plan, is a generally rectangular opening. Through opening 26 in FIG. 2, as well as in FIG. 3, can be seen an annular, through-hull fitting 28 having a flange 30 which rests against the outer surface of the hull around an opening through the hull. The through-hull fitting itself is conventional. An externally threaded, hollow pipe 32 extends from flange 30 into the vessel and is held in place by a nut 34 which holds the flange against the hull. As best seen in FIG. 3, access opening 26 extends from the rear inner edge of rim plate 12 to a point forward of the opening through annular fitting 28. In addition, a sector at the rear end of rim plate 12 is recessed at 36 in alignment with opening 26 and has a central, internally threaded opening 38.

A cover 40 is pivotally mounted in opening 26 and is shaped to have an outer surface conforming to the shape of the adjacent portions of strainer 20. Cover 40 also has a flange 42 which is dimensioned to fit into recess 36 and a central opening 44 which is aligned with opening 38 when the cover is closed. A machine screw 46 having an hexagonal head passes through opening 44 and threadedly engages opening 38 to hold cover 40 closed.

Figure 4:
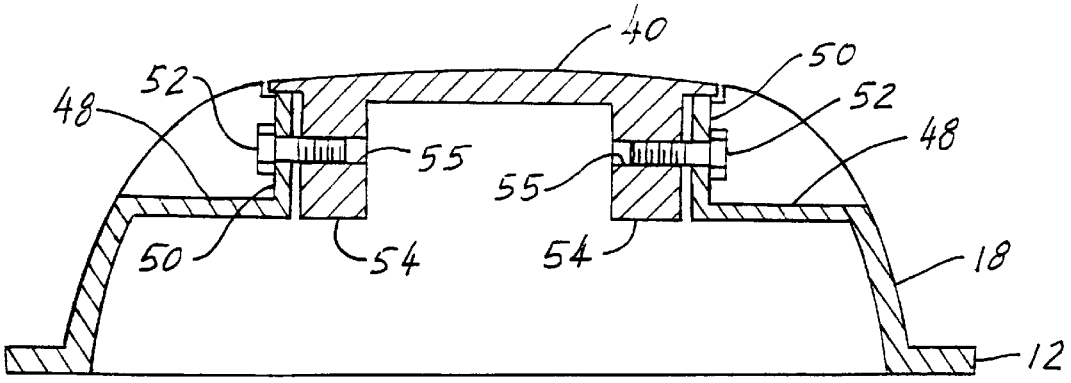
FIG. 4 is a partial transverse sectional view of a hinge structure usable in the embodiment of FIGS. 1–3.

At the forward end of cover 40 is a hinge or pivotal mounting for the cover which can take various forms. In the embodiment shown in FIG. 4, shell 18 is formed with indentations 48 in the outer surface thereof, the indentations having parallel side walls 50 with transversely aligned central openings through which machine screws 52 pass. Cover 40 is provided at its forward end with trunnion blocks 54 having transversely aligned openings 55 which receive the inner ends of screws 52. Screws 52 thus act as hinge pins forming a pivot support for the cover. This permits the cover to swing open, completely exposing not only the interior of the strainer but also the interior of pipe 32 so that easy access to the interior of the pipe is available for cleaning. After cleaning, the access door is closed and fastened shut using machine screw 47. Because screw 47 threads into rim plate 12 which is metal, the threading and unthreading process can be repeated endlessly without degradation of the threads or the material in which they are formed. Screws 14 which are screwed into the hull material are installed only once and, generally speaking, never need to be removed for cleaning purposes.

Cover 40 preferably has lateral flanges 56 which overlie the edges of opening 26, forming a seal to inhibit the flow of water between the door and the interior of shell 18. This forces water which enters through openings 24 into pipe 32 rather than letting it escape, thereby promoting water flow to the place where it can perform its desired task, such as cooling.

As will be recognized, the components shown herein are preferably made of brass, bronze or a similarly salt-water resistant material. It is also possible to make the entire scoop strainer out of an impact-resistant plastic material. However, in this case, it is desirable to mold an internally threaded metal insert into the aft end of rim plate 12 to provide a threaded hole 38 of metal so that fastener 44 still threads into a metal opening.

While certain advantageous embodiments have been chosen to illustrate the invention, it will be understood by those skilled in the art that various changes and modifications can be made therein without departing from the scope of the invention as defined in the appended claims.

What is claimed is:

1. A scoop strainer for admitting water to a through-hull fitting in a marine vessel, the strainer comprising the combination of a shell having an interior and an open side;

means for attaching said shell substantially permanently to said hull with said open side of said shell toward said hull and with said shell overlying said through-hull fitting;

means defining a plurality of water passage openings through said shell to admit water to said interior;

an access opening through said shell;

a cover movable between a closed position in which said cover substantially closes said access opening and an open position in which said cover permits unobstructed access to said interior of said shell and to the interior of said through-hull fitting;

means for supporting said cover for pivotal motion between said closed and open positions; and means for selectively holding said cover in said closed position.

2. A scoop strainer according to claim 1 wherein said means for attaching comprises a metal rim plate forming a flange around said open side of said shell, said rim plate having a threaded opening therein; and a plurality of fastener means for attaching said rim plate to said hull.

3. A scoop strainer according to claim 2 wherein said means for selectively holding said cover in said closed position comprises a hole through said cover aligned with said threaded opening in said rim plate when said cover is in said closed position, and an externally threaded fastener extending through said hole in said cover and engageable with said threaded opening in said rim plate to hold said cover securely closed.

4. A scoop strainer according to claim 1 wherein said means for selectively holding said cover in said closed position comprises a rim plate on said shell having an opening therein;

a hole through said cover aligned with said opening in said rim plate when said cover is in said closed position; and a fastener extending through said hole in said cover and engageable with said opening in said rim plate to hold said cover securely closed.

* * * * *